US006621018B1

(12) United States Patent
Chen

(10) Patent No.: US 6,621,018 B1
(45) Date of Patent: Sep. 16, 2003

(54) RECIPROCAL SWITCH

(75) Inventor: Hsin-Hsun Chen, Hsin-Tien (TW)

(73) Assignee: Shin Jiuh Corp., Taipei Hsien (TW)

( * ) Notice: Subject to any disclaimer, the term of this patent is extended or adjusted under 35 U.S.C. 154(b) by 0 days.

(21) Appl. No.: 10/127,717

(22) Filed: Apr. 23, 2002

(51) Int. Cl.[7] ..... H01H 15/00; H01H 9/02
(52) U.S. Cl. ..... 200/16 C; 200/550; 200/303
(58) Field of Search ..... 200/16 C, 16 D, 200/547–552, 61.27–61.38, 61.54, 303

(56) References Cited

U.S. PATENT DOCUMENTS 2,683,193 A * 7/1954 Barcus ..... 200/16 C
2,882,358 A * 4/1959 Dryer ..... 200/61.27 X
2,900,460 A * 8/1959 Wallace ..... 200/551 X
2,916,567 A * 12/1959 Floam et al. ..... 200/16 C
2,977,432 A * 3/1961 Spicer, Jr. ..... 200/16 C
3,106,619 A * 10/1963 Scheid ..... 200/61.27 X
3,461,256 A * 8/1969 Ferryman, Jr. ..... 200/61.54 X

* cited by examiner

*Primary Examiner*—J. R. Scott
(74) *Attorney, Agent, or Firm*—Birch, Stewart, Kolasch & Birch, LLP

(57) ABSTRACT

A reciprocal switch includes a shell with a stopper located therein, a connecting unit located on two sides of the stopper for generating circuit signals, two conducting units having movable contacts located on two sides of the stopper and engaged with an elastic element, and a displacement unit located between the two conducting units and exposed outside the shell. The displacement unit may be moved when subject to an external force to move the conducting units moving to either side to press the connecting unit on one side to generate circuit signals.

8 Claims, 4 Drawing Sheets

RECIPROCAL SWITCH

FIELD OF THE INVENTION

The present invention relates to a reciprocal switch and particularly to a reciprocal switch for electronic products.

BACKGROUND OF THE INVENTION

With continuous developments of technology, still cameras and video cameras have gradually switched from manually adjusting and mechanical types to automatic and electronic types. And functions are richer than ever and operations become more user-friendly. The so called "Smart Cameras" are very popular these days. Even novice users can take good quality pictures like professional photographers do.

The general electronic automatic cameras and video cameras mostly have automatic zoom in/zoom out function. Coupling with an automatic focusing lens, the zoom in function can get clear close up pictures while the zoom out function can get pictures of a greater field of depth and a wider angle. On automatic cameras or video cameras, the zoom in/zoom out function generally is controlled by two separated pushbuttons. Such a design incurs problems in practical use, notably:

1. It takes more space: To install two pushbuttons on an ever shrinking camera or video camera becomes increasingly difficult, and contradicts the trend of lean and light design concept and requirement that prevail in the market place.
2. Difficult operation: As sizes of cameras and video cameras have been shrunk continuously, the two pushbuttons for zoom in/zoom out also have to crowd in a smaller space. However, the pressing action of human fingers on the pushbuttons is on a surface rather than on a single point, the two pushbuttons located too close to each other make user operation difficult and are prone to trigger erroneous actions.
3. Not ergonomics: The pressing operation of human fingers tends to generate shaking (like triggering a pistol) and often results in blurred pictures and poor picture quality.

SUMMARY OF THE INVENTION

Therefore the primary object of the invention is to resolve aforesaid disadvantages. The invention provides a reciprocal switch that has a smaller size, is easier to operate and conforms to ergonomics.

In order to achieve the foregoing object, the invention includes a shell with a slot formed on the top surface, a stopper located in the shell, a connecting unit located on two sides of the stopper for generating circuit signals, two conducting units located in the shell on two sides of the stopper and engaged with an elastic element, and a displacement unit located between the two conducting units and exposed outside the shell. The displacement unit may be moved when subject to an external force to drive one of the conducting units to press the connecting unit on one side to generate circuit signals. Another conducting unit is retained by the stopper and the elastic element is stretched to create a restoring force. When the external force is released, the switch may return to its original position.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
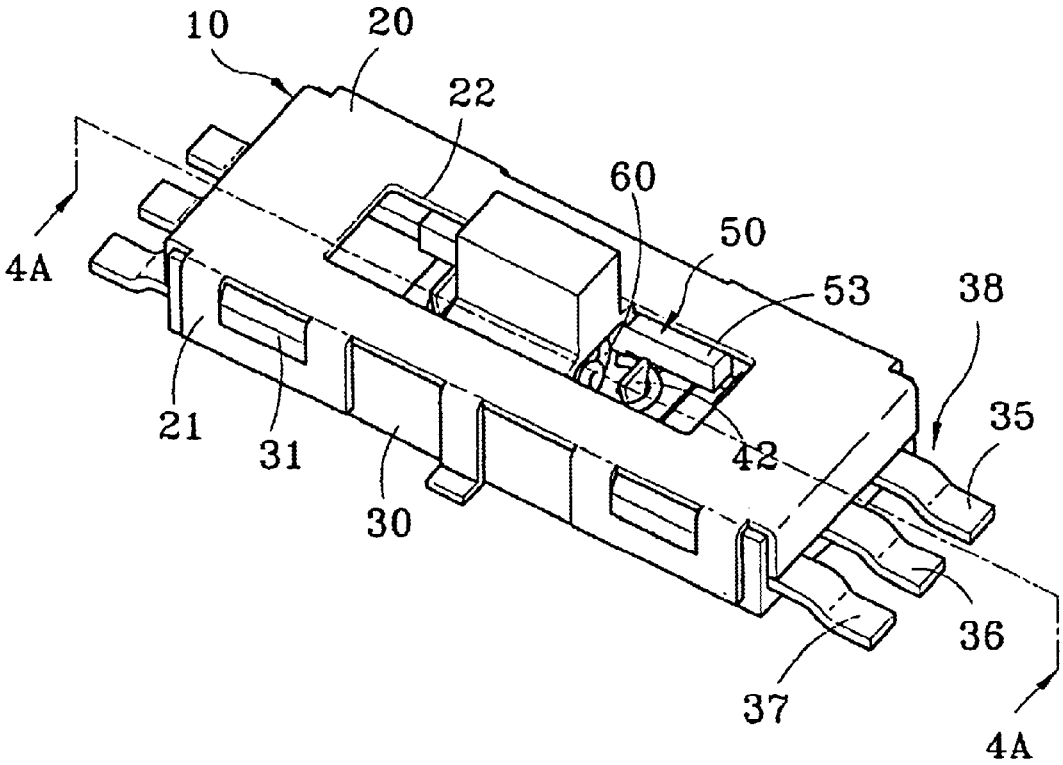
FIG. 1 is a perspective view of the invention including section lines 4A—4A along which the view of FIG. 4A is taken.
Figure 2:
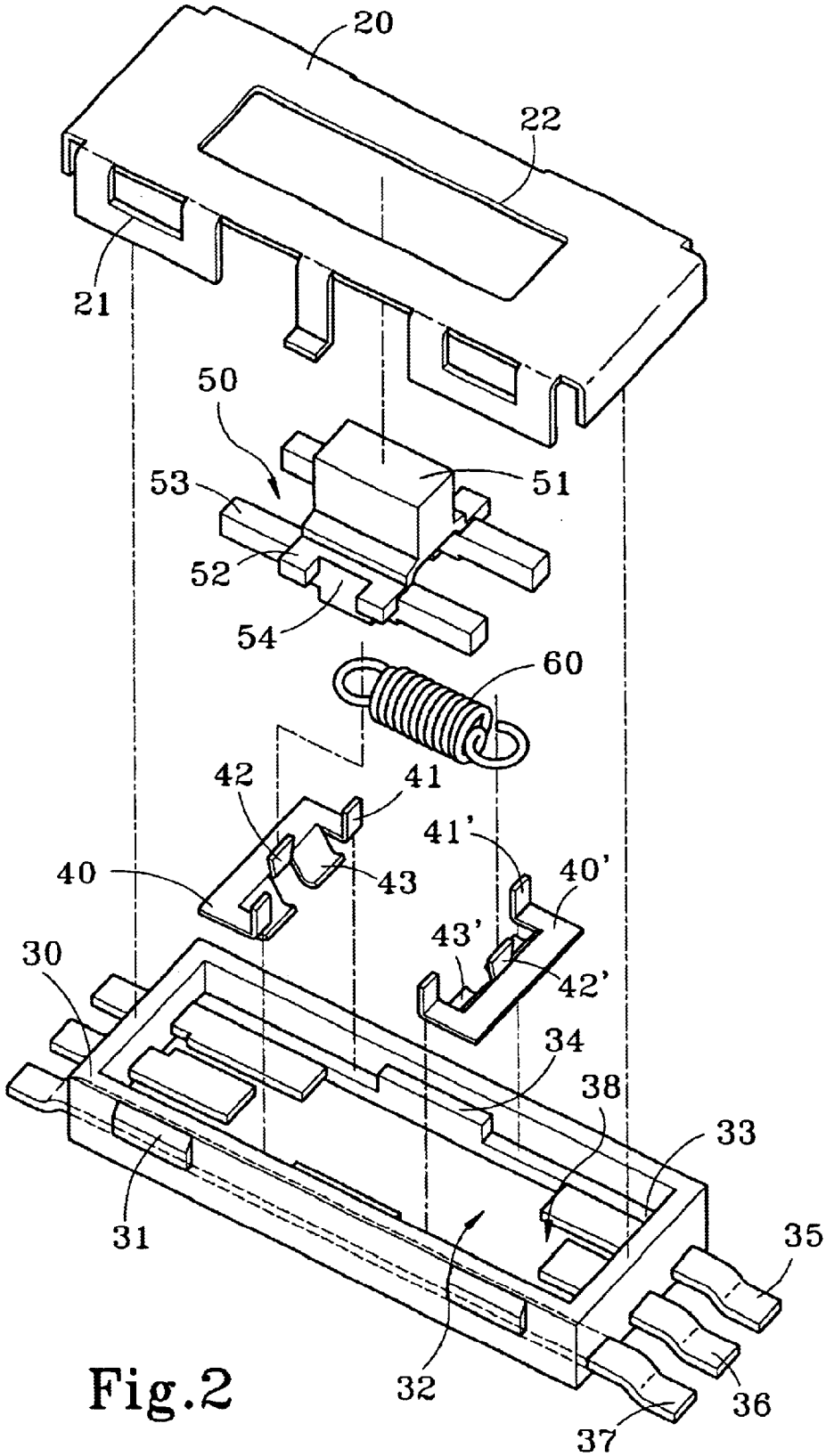
FIG. 2 is an exploded view of the invention.

Referring to FIGS. 1 and 2, the reciprocal switch of the invention mainly includes a shell 10 having a connecting unit 38 located therein, two conducting units 40 and 40' located in the shell 10 and a displacement unit 50 for moving the conducting units 40 and 40'. When the displacement unit 50 subjects to an external force, it drives the conducting units 40 and 40' to connect the connecting unit 38 located on one side of the shell to provide switch function.

The shell 10 consists of a cap 20 and a matching seat 30. The cap 20 and the seat 30 have respectively a latch opening 21 and a latch lug 31 engageable with each other to allow the cap 20 and the seat 30 forming a secured fastening. The cap 20 has a top surface with a slot 22 formed thereon. The seat 30 has a rectangular housing compartment 32 formed therein. On two longitudinal side walls of the housing compartment 32, there are two symmetrical sliding channels 33 for mounting the conducting units 40 and 40'. In the middle section of the sliding channels 33, there is a stopper 34. The connecting unit 38 is located on the bottom section of the housing compartment 32 and has two sets located on two sides of the stopper 34. The connecting unit 38 at each side includes a contact leg 35 and a common leg 37 for generating circuit signals.

Figure 3:
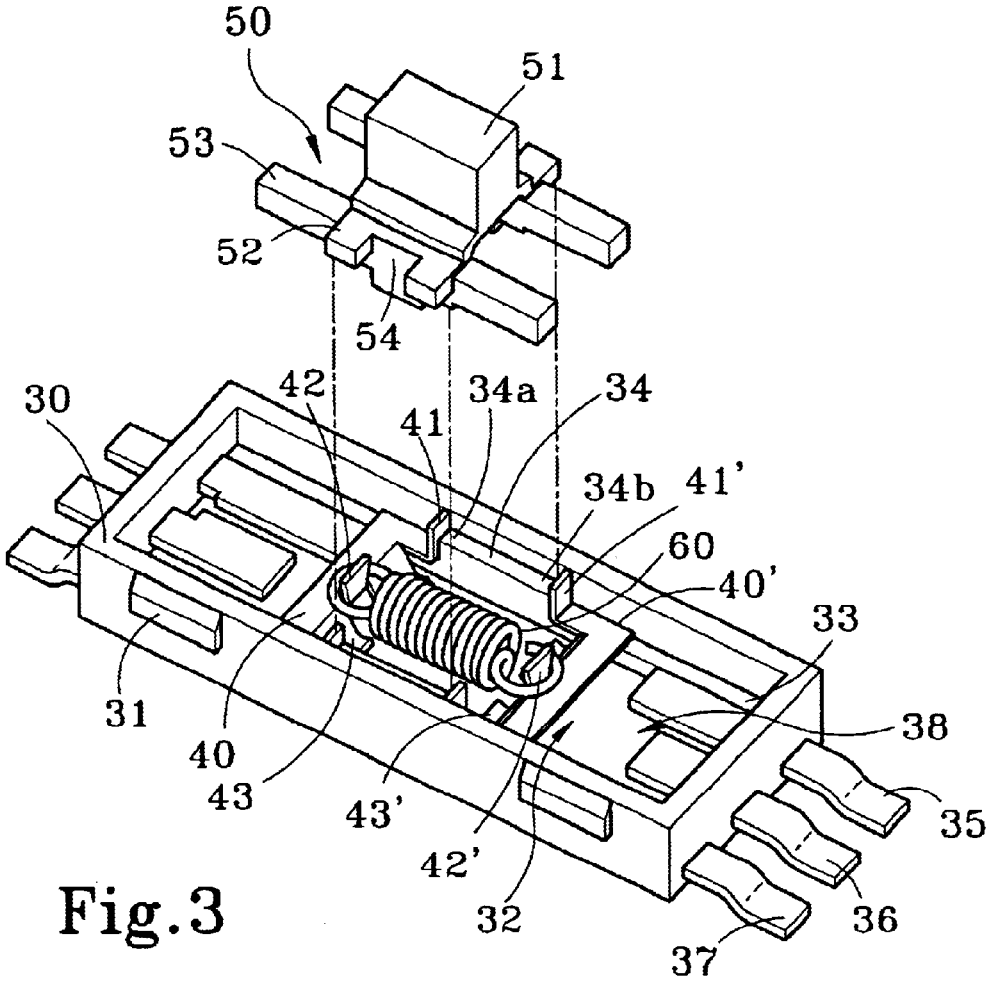
FIG. 3 is a fragmentary schematic view of the invention, assembled.

The conducting units 40 and 40' are made of metal. Each conducting unit has a brake ledge 41, 41' located on one side to press against the stopper 34 under force, a retain section 42, 42' located in the middle and a conductive flange 43, 43' for connecting the contact leg 35 and the common leg 37. The conductive flange 43, 43', brake ledge 41, 41' and the retain section 42, 42' are integrally formed. The conductive flange 43, 43' has sufficient elasticity to effectively make electrical contact with the connecting unit 38. Referring to FIG. 3, when assembled, the two conducting units 40 and 40' are mounted and paired with each other, and are connected by an elastic element 60 on the retain section 42, 42' for restraining the relative motion of the conducting units 40 and 40'. The elastic element 60 is slightly stretched to pull the two conducting units 40 and 40' anchoring on two sides 34*a* and 34*b* of the stopper 34, and mounting on the sliding channels 33. Because of the elastic element 60, the brake ledge 41, 41' of the conducting units 40 and 40' presses against the lateral side of the stopper 34.

The displacement unit 50 is located between the conducting units 40 and 40', and has a strut 51 located on the top surface passing through the slot 22 of the cap 20 to receive the force from an user, and has two driving sections 52 located on two sides for moving the conducting units 40 and 40'. The displacement unit 50 further has two pairs of transverse beams 53 extending from another two sides for pressing the conducting units 40 and 40' to prevent the conducting units 40 and 40' from being toppled by the elastic element 60 when stretched to keep the assembly securely. The displacement unit 50 also has a bordering section 54 extending from the bottom section thereof to hold the elastic element 60 from being displaced when stretched.

After the displacement unit 50 is assembled, the cap 20 is coupled with the seat 30, with the latch opening 21 engaging with the latch lug 31 to form a secured fastening between the cap 20 and the seat 30, and to complete the assembly of the reciprocal switch of the invention.

Figure 4A:
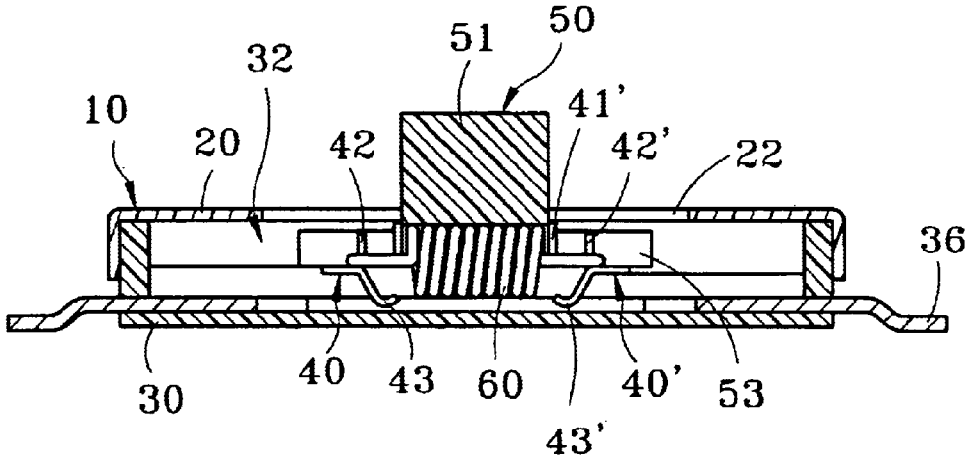
FIGS. 4A, 4B and 4C are schematic views of the invention in various operating conditions according to FIG. 1.
Figure 4B:
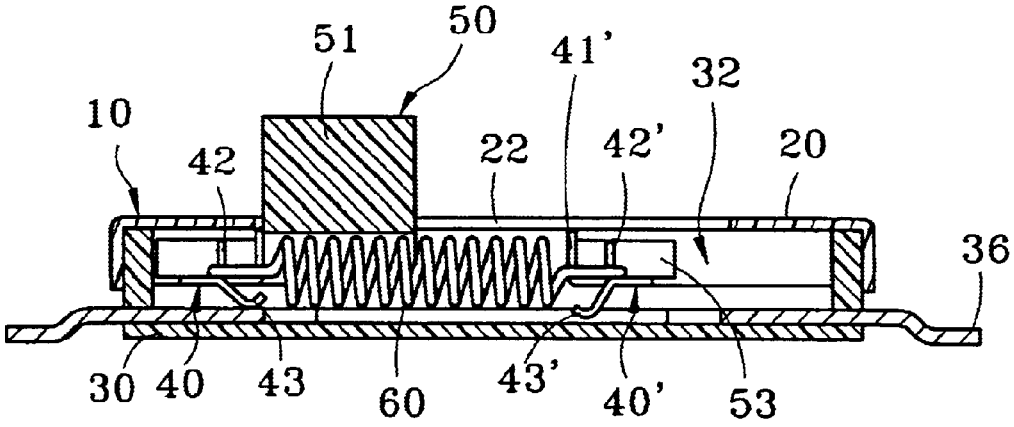
Figure 4C:
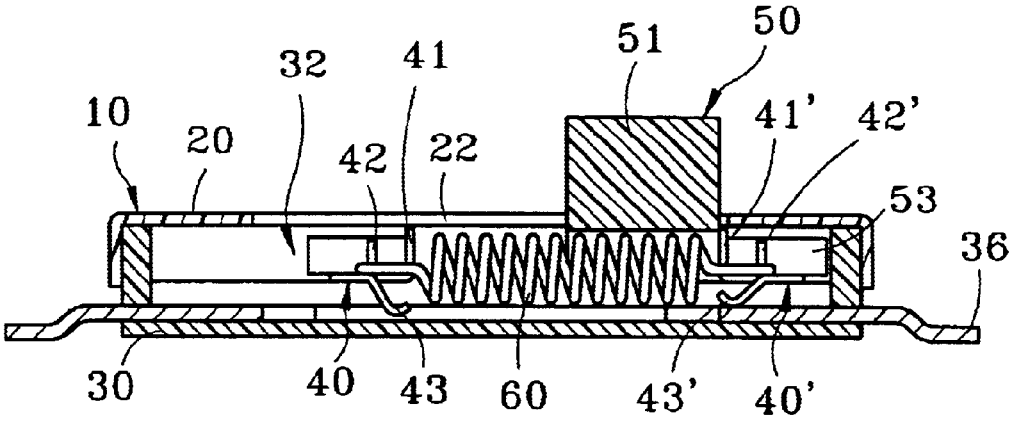

When the reciprocal switch of the invention is adopted in electrical devices such as the zoom lens of cameras or video cameras, it may be used to zoom out or zoom in the lens. As shown in FIGS. 4A and 4B, for zooming in the lens, push the strut 51 (assuming moving to the left is for zooming in the lens), the driving section 52 of the displacement unit 50 drives the conducting unit 40 to the left for a selected displacement independently of another conducting unit 40' on the right hand side, which is stopped by the stopper 34. As a result, the elastic element 60 is stretched to allow the conducting unit 40 on the left to generate a touched feeling for the user and create a restoring force. Moving the conducting unit 40 further to the left, the conductive flange 43 of the conducting unit 40 contacts the contact leg 35 and the common leg 37 on the left hand side to generate a circuit signal to control zoom in operation of the lens. This circuit signal is used to control a motor or a similar operation which causes the lens to move so as to focus on a more distant object. To zoom out the lens, as shown in FIGS. 4A and 4C, move the strut 51 to another direction (such as to the right hand side). In this situation, a signal is sent to the motor to drive the lens in the opposite direction so that the lens focuses on a more nearby object. The operation is similar to the zoom in operation, details are omitted here. When the strut is released, the conducting unit is returned to the normal centered position by elastic element 60.

In order to accomplish multiple switching function, a secondary leg 36 of a shorter length than the contact leg 35 may be deployed on one side of the contact leg 35. When the displacement unit 50 drives the conducting units 40 and 40', different moving displacements of the displacement unit 50 may enable the conducting units 40 and 40 to contact the contact leg 35 or the secondary leg 36 to generate different circuit signals to accelerate adjustment or adjust in a staged manner for the lens of the camera or video camera.

What is claimed is:

1. A reciprocal switch for variable closed switching patterns, comprising:

a shell having a slot formed on a top surface thereof, a stopper located therein, and a fixed contact connecting unit located respectively on two sides of the stopper for generating circuit signals;

a displacement unit located in the shell having a strut mounted to a top surface thereof extending through the slot; and two sets of movable bridging contact conducting units located respectively on two sides of the displacement unit connected by an elastic element and having respectively a conductive flange for connecting contact legs of the connecting unit, and a pair of brake ledges on two sides thereof to contact two lateral sides of the stopper;

wherein the strut is movable to either side of the switch when subjected to an external force and drives the displacement unit to move the conducting units such that the conductive flange of one conducting unit presses the connecting unit at one side to generate circuit signals and the brake ledge of another conducting unit is stopped by the stopper to allow the elastic element to stretch to generate a restoring force, and the displacement unit being returned to its original position when the external force is released.

2. The reciprocal switch of claim 1, wherein the shell includes a cap and a seat which have respectively a latch opening and a latch lug matching and engageable with each other.

3. The reciprocal switch of claim 1, wherein the shell has a housing compartment which has two sliding channels formed on two sides thereof to allow the conducting units sliding thereon.

4. The reciprocal switch of claim 1, wherein each of the connecting units includes a contact leg, a secondary contact leg with a shorter length than the contact leg and a common leg said legs being engaged by a displaced movable contact of the displacement unit to generate different circuit signals depending on different moving displacements of the displacement unit.

5. The reciprocal switch of claim 1, wherein each of the conducting units has a retain section for engaging with the elastic element.

6. The reciprocal switch of claim 1, wherein the displacement unit has two sides each having a driving section located thereon to press the brake ledge for moving the conducting units.

7. The reciprocal switch of claim 6, wherein the displacement unit has two other sides each having a transverse beam extending therefrom to press the conducting units to provide a secured assembly of the switch.

8. The reciprocal switch of claim 1, wherein the displacement unit has a bordering section located on a bottom section thereof for holding the elastic element.

* * * * *